US007377082B1

(12) United States Patent
Edwards

(10) Patent No.: US 7,377,082 B1
(45) Date of Patent: May 27, 2008

(54) INSULATIVE PANEL INCORPORATING A SUPPORT BEAM

(76) Inventor: Richard D. Edwards, 440 Ashbury Ct., Monroeville, PA (US) 15146

( * ) Notice: Subject to any disclaimer, the term of this patent is extended or adjusted under 35 U.S.C. 154(b) by 563 days.

(21) Appl. No.: 10/990,730

(22) Filed: Nov. 17, 2004

(51) Int. Cl.
*E04B 2/00* (2006.01)
*E04C 2/34* (2006.01)

(52) U.S. Cl. ..... 52/588.1; 52/309.9; 52/794.1; 52/592.1

(58) Field of Classification Search ..... 52/592.3, 52/794.1, 796.1, 270, 588.1, 309.11, 591.1, 52/800.12, 309.9, 592.1
See application file for complete search history.

(56) References Cited

U.S. PATENT DOCUMENTS 3,372,520 A * 3/1968 Hensel ..... 52/489.1
3,742,672 A * 7/1973 Schaeufele ..... 52/592.1
3,760,548 A * 9/1973 Sauer et al. ..... 52/592.1
4,075,811 A * 2/1978 Keith ..... 52/395
4,918,895 A * 4/1990 Landheer ..... 52/580
4,936,069 A * 6/1990 Hunter et al. ..... 52/309.4
5,613,338 A * 3/1997 Esposito ..... 52/588.1
6,122,879 A * 9/2000 Montes ..... 52/592.1
6,256,959 B1 * 7/2001 Palmersten ..... 52/588.1
6,279,287 B1 * 8/2001 Meadows ..... 52/589.1
6,298,619 B1 * 10/2001 Davie ..... 52/293.3
6,718,721 B2 * 4/2004 Albany et al. ..... 52/588.1
2003/0046892 A1 * 3/2003 Albany et al. ..... 52/588.1

FOREIGN PATENT DOCUMENTS

FR 2604739 A1 * 4/1988

* cited by examiner

*Primary Examiner*—Robert Canfield
*Assistant Examiner*—Jessie Fonseca
(74) *Attorney, Agent, or Firm*—Richard K Thomson

(57) ABSTRACT

A panel for constructing patio rooms, and the like, has a reinforcing offset I-beam extending along a first edge of the insulative board. A second lateral edge of the board has a reduced thickness portion which fits into the open side of the I-beam and forms two pockets which accommodate the engagement of two sets of spring fingers which positionally locate and secure adjacent panels together.

7 Claims, 2 Drawing Sheets

INSULATIVE PANEL INCORPORATING A SUPPORT BEAM

BACKGROUND AND SUMMARY OF THE INVENTION

The present invention is directed to the field of building construction. More particularly, the present invention involves a reinforced insulative panel particularly useful in constructing "Florida rooms", i.e., two, three and four season patio rooms.

So called "Florida rooms" have had increasing popularity in the Northeastern and upper Midwestern United States, particularly as the capabilities of available insulative materials have improved. Blocks of closed-cell foam serve as structural panels in walls and roofs. While these panels have desirable insulative qualities and are light weight, they typically lack adequate structural rigidity, particularly in the roofing application where load bearing requirements imposed on building contractors by most construction codes require that the roof be able to support a weight equivalent to two workmen. In addition, an alternate method of attaching/aligning adjacent panels is needed.

The insulative panel of the present invention comprises an insulative board having a first thickness; a reinforcing beam extending substantially a full width of the first thickness along a first edge of the insulative board, the reinforcing beam embracing the first edge and having an open side facing outwardly from the first edge; a first sheet metal skin covering an upper surface of the insulative board; a second sheet metal skin covering a lower surface of the insulative board; a second edge of the insulative board having a reduced thickness forming a first pocket above a center line of the insulative board and a second pocket below the center line of the insulative board; first spring attachment means formed along and extending outwardly beyond the first edge of the insulative board; second spring attachment means formed along the second edge of the insulative board; whereby the second edge of a second panel can be inserted into the open side of the first edge of a first panel, the second spring attachment means of the second panel engaging the first spring attachment means of the first panel to securely locate the first and second panels relative to each other.

Preferably, the reinforcing beam comprises an off-set I-beam having a central web and a first set of flanges extending in a first direction and a second set of flanges off-set from the first set extending in an opposite direction. The central web has a thermal break therein bridged by a material having reduced thermal conductivity. The thermal break forms a lateral protrusion which extends into the open side, the second edge having a recess to accommodate the lateral protrusion.

The first spring attachment means is fabricated from a portion of the first and second sheet metal skin coverings extending beyond the first edge and the second spring attachment means is fabricated from a portion of the first and second sheet metal skin coverings extending beyond portions of the second edge and lying in the first and second pockets. The first and second spring attachment means are preferably formed as complementary geometrically shaped fingers which engage in the first and second pockets. Most preferably, the complementary geometrically shaped fingers have a V-shape in which a closed point thereof protrudes away from second edge having reduced thickness.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
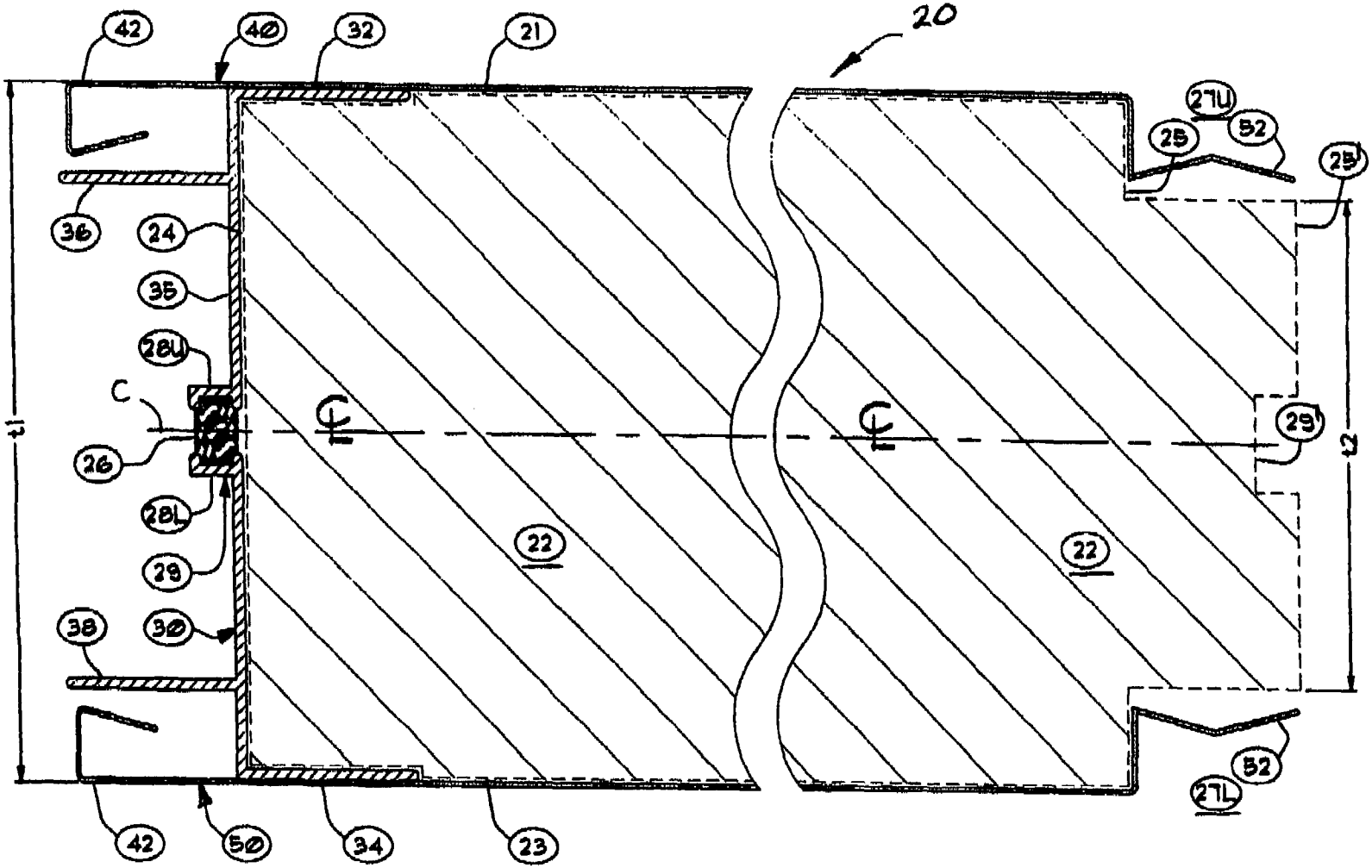
FIG. 1 is a cross-sectional side view of a first embodiment of the insulative panel of the present invention.
Figure 2:
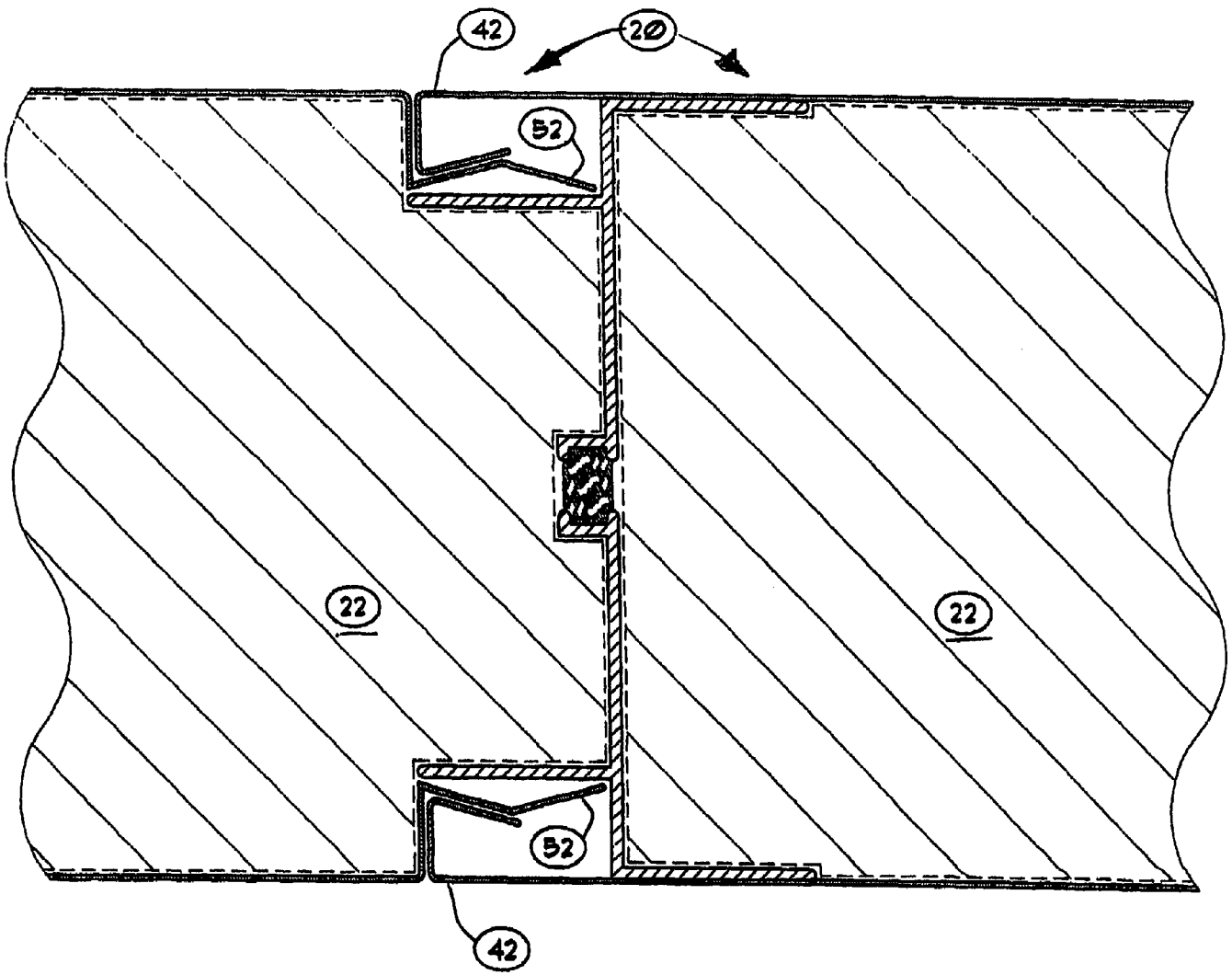
FIG. 2 is a cross-sectional side view showing two adjacent panels engaged.

A first embodiment of the insulative panel of the present invention is shown in FIGS. 1 and 2 generally at 20. Insulative board 22 is constructed of a closed-cell foam and has a first thickness t, which, by way of example, may be 4". These panels 20 are constructed in lengths up to 40' and widths of 2', 4' 6' and 8', depending on the application. First edge 24 of insulative board 22 has affixed thereto a reinforcing beam 30. Typically, beam 30 is secured to first edge 24 using an adhesive. Preferably, support beam 30 is an I-beam with a first pair of flanges 32, 34 extending outwardly from the ends of central web 35 in a first direction and a second pair of flanges 36, 38 extending in the opposite direction and being laterally offset from the first pair 32, 34, said flanges 36, 38 defining an open side. By way of example, these offsets are ½" and are provided to afford room for the panel connections. Preferably, central web 35 is formed with a thermal break positioned along its centerline in which an elastomer or plastic block 26 is bonded between a pair of C-shaped mini-flanges 28U and 28L which form a lateral protrusion 29. Block 26 has a significantly lower coefficient of thermal conductivity than that of I-beam 30 reducing the amount of heat conducted into and out of the room constructed with panels 20. Second edge of board 22 has a first portion 25 with a thickness of $t_1$ and a second portion 25' of reduced thickness $t_2$ which defines a first pocket 27U above the centerline C of board 22 and a second pocket 27L below the centerline C. Second portion 25' also has a recess 29' to receive protrusion 29 of an adjacent board 22. Thickness $t_2$ of second portion 25' is dimensioned to fit in open side of offset I-beam 30 between flanges 36, 38.

Upper surface 21 of board 22 has a first sheet metal skin 40 bonded thereto and lower surface 23 has second sheet metal skin 50 bonded thereto. A first portion of first skins 40 and 50 extends beyond first end 24 of board 22 and are bent to form first spring attachment means 42. A second portion of skins 40 and 50 extend beyond second end 25 into pockets 27U and 27L and are bent into second spring means 52. First spring means 42 and second spring means 52 are configured as complementary geometrically shaped fingers which engage each other in pockets 27U and 27L. More preferably, second spring means 52 are configured as V-shaped fingers in which the point of the V's extend away from the centerline C of board 22.

A panel 20 can be assembled to an adjacent panel 20 which is already attached to the building (not shown) by either axially sliding second spring fingers 52 in under first spring fingers 42 or, more preferably, snapping spring fingers 52 under spring fingers 42 by moving the unsecured panel 20 laterally toward the in-place panel 20. Second spring fingers 52 will be compressed between the ends of first spring fingers 42 and flanges 36 and 38 and then snap back as the gap between panels 20 is closed. While the specifics of the installation will dictate which assembly technique is employed, it is believed that the lateral snap together method will principally be used unless access is inhibited and thereby requires the axial sliding technique.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A panel for use in constructing a building comprising:

a) an insulative board having a first thickness and a first maximum lateral extent;

b) a reinforcing beam extending substantially a full width of said first thickness along a first edge and only along said first edge of said insulative board, said reinforcing beam having a first pair of flanges embracing said first edge and having a second pair of inwardly offset, oppositely directed flanges defining an open side facing outwardly from said first edge beyond said first maximum lateral extent;

c) a first sheet metal skin covering an upper surface of said insulative board;

d) a second sheet metal skin covering a lower surface of said insulative board;

e) a second edge of said insulative board having a region of reduced thickness forming a first pocket above a centerline of said insulative board and a second pocket below said centerline of said insulative board, said region of reduced thickness adapted to be received between a pair of outwardly directed flanges at an open side of a second like panel;

f) first spring attachment means formed along and extending outwardly beyond said first edge of said insulative board, said first spring attachment means being fabricated from a portion of said first and second sheet metal skin coverings beyond said first edge;

g) second spring attachment means formed along said second edge of said insulative board, said second spring attachment means being fabricated from a portion of said first and second sheet metal skin coverings extending beyond portions of said second edge and lying in said first and second pockets;

whereby said second edge of a second panel can be inserted into said open side of said first edge of a first panel, said second spring attachment means of said second panel engaging said first spring attachment means of said first panel to securely locate said first and second panels relative to each other.

2. The panel of claim 1 wherein said reinforcing beam comprises an off-set I-beam having a central web and said first pair of flanges extending in said first direction and said second pair of flanges inwardly off-set from said first pair of flanges and extending in an opposite direction.

3. The panel of claim 2 wherein said central web has a thermal break therein bridged by a block of material having reduced thermal conductivity.

4. The panel of claim 3 wherein said thermal break forms a lateral protrusion which extends outwardly in between said second pair of flanges of said first edge, said second edge having a recess to accommodate said lateral protrusion.

5. The panel of claim 4 wherein said lateral protrusion comprises a pair of C-shaped mini-flanges to which said block of material is bonded.

6. The panel of claim 1 wherein said first spring attachment means extending beyond said first edge and said second spring attachment means extending beyond said second edge are formed as complementary geometrically shaped fingers.

7. The panel of claim 6 wherein said fingers of second spring attachment means each have a V-shape in which a closed point thereof protrudes away from said centerline of said board.

* * * * *